United States Patent [19]

Sato et al.

[11] Patent Number: 4,731,321

[45] Date of Patent: Mar. 15, 1988

[54] HEAT DEVELOPABLE LIGHT-SENSITIVE MATERIAL

[75] Inventors: Kozo Sato; Yoshiharu Yabuki; Hiroyuki Hirai; Ken Kawata, all of Kanagawa, Japan

[73] Assignee: Fuji Photo Film Co., Ltd., Kanagawa, Japan

[21] Appl. No.: 942,042

[22] Filed: Dec. 16, 1986

Related U.S. Application Data

[63] Continuation of Ser. No. 769,290, Aug. 26, 1985, abandoned.

[30] Foreign Application Priority Data

Aug. 24, 1984 [JP] Japan ..... 59-176398

[51] Int. Cl.[4] ..... G03C 1/06

[52] U.S. Cl. ..... 430/559; 430/617; 430/619; 430/620; 430/543; 430/570; 430/560; 430/562; 430/203; 430/351; 430/353; 430/955

[58] Field of Search ..... 430/617, 619, 620, 543, 430/559, 570, 560, 562, 203, 351, 353, 955, 151, 179, 495

[56] References Cited

U.S. PATENT DOCUMENTS 3,220,846 11/1965 Tinker et al. ..... 430/151
4,487,826 12/1984 Watanabe et al. ..... 430/151
4,514,493 4/1985 Hirai et al. ..... 430/619

FOREIGN PATENT DOCUMENTS 909491 10/1962 United Kingdom ..... 430/151

*Primary Examiner*—Won H. Louie
*Attorney, Agent, or Firm*—Sughrue, Mion, Zinn, Macpeak, and Seas

[57] ABSTRACT

A heat developable light-sensitive material comprising a support having thereon at least one light-sensitive layer wherein at least one layer comprises a compound represented by the following general formula (I):

(I)

wherein $R_1$ and $R_2$, which may be the same or different, each represents a hydrogen atom, an alkyl group, a cycloalkyl group, an alkenyl group, an alkynyl group, an aralkyl group, an aryl group, a heterocyclic group each of which may be substituted or unsubstituted; a carboxy group or a salt thereof; $R_3$ and $R_4$, which may be the same or different, each represents a hydrogen atom, a halogen atom, an alkyl group, a cycloalkyl group, an alkenyl group, an alkynyl group, an aryl group, an aralkyl group, a heterocyclic group, a sulfamoyl group, a carbamoyl group, an acyl group, an alkoxy group, an aryloxy group, an amino group, an acylamino group, an alkoxycarbonyl group, an aryloxycarbonyl group, an acyloxy group each of which may be substituted or unsubstituted; a phosphoryl group, a phosphinyl group, a thio group, a sulfinyl group or a sulfonylamino group, each of which is substituted with a substituted or unsubstituted alkyl group or aryl group; a cyano group, a hydroxy group, a carboxy group or a salt thereof; $X_0$ represents a group capable of accelerating decarboxylation; $B_0$ represents an organic base; and $n_0$ represents 1 when $B_0$ represents a monoacidic base or 2 when $B_0$ represents a diacidic base.

The heat developable light-sensitive material containing a base precursor represented by the general formula (I) has excellent stability during preservation and provides a color image having a high color density and low fog in a short development time.

27 Claims, No Drawings

HEAT DEVELOPABLE LIGHT-SENSITIVE MATERIAL

This is a continuation of application Ser. No. 769,290, filed Aug. 26, 1985, abandoned.

FIELD OF THE INVENTION

The present invention relates to a heat developable light-sensitive material containing a base precursor.

BACKGROUND OF THE INVENTION

Bases or base precursors are frequently incorporated into heat developable light-sensitive materials for the purpose of accelerating development upon heating. In view of shelf life of the light-sensitive materials, it is preferred to employ base precursors which release basic substances upon heat decomposition.

Examples of typical base precursors are described in British Pat. No. 998,949. One such base precursor is a salt of a carboxylic acid and an organic base, in which examples of suitable carboxylic acids include trichloroacetic acid and trifluoroacetic acid and examples of suitable bases include guanidine, piperidine, morpholine, p-toluidine and 2-picoline.

Guanidine trichloroacetate is described as a base precursor in U.S. Pat. No. 3,220,846, and aldonic amides as described in Japanese Patent Application (OPI) No. 22625/75 (the term "OPI" as used herein refers to a "published unexamined Japanese patent application") are described as decomposing at a high temperature to form bases.

When these known base precursors are employed in a heat developable light-sensitive material, however, the following problems are often encountered. Specifically, a relatively long development time is required for obtaining images and a high level of fog is formed. Further, they have the disadvantage that the base precursors are susceptible to air and humidity and decompose, changing the photographic properties of the light-sensitive materials and seriously reducing the shelf life of the light-sensitive materials.

SUMMARY OF THE INVENTION

Therefore, an object of the present invention is to provide a heat developable light-sensitive material containing a base precursor having good shelf life and capable of forming an image having a high density in a short time.

This and other objects of the present invention will become more apparent from the following detailed description and examples.

These objects of the present invention are accomplished with a heat developable light-sensitive material comprising a support having thereon at least one light-sensitive layer, wherein at least one layer comprises a compound represented by the following general formula (I):

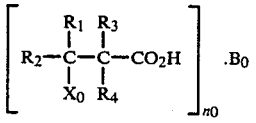

(I)

wherein $R_1$ and $R_2$, which may be the same or different, each represents a hydrogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, a substituted or unsubstituted heterocyclic group, a carboxy group or a salt thereof; $R_3$ and $R_4$, which may be the same or different, each represents a hydrogen atom, a halogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aryl group, a substituted or unsubstituted aralkyl group, a substituted or unsubstituted heterocyclic group, a substituted or unsubstituted sulfamoyl group, a substituted or unsubstituted carbamoyl group, a substituted or unsubstituted acyl group, a substituted or unsubstituted alkoxy group, a substituted or unsubstituted aryloxy group, a substituted or unsubstituted amino group, a substituted or unsubstituted acylamino group, a substituted or unsubstituted alkoxycarbonyl group, a substituted or unsubstituted aryloxycarbonyl group, a substituted or unsubstituted acyloxy group, a phosphoryl group substituted with a substituted or unsubstituted alkyl group or aryl group, a phosphinyl group substituted with a substituted or unsubstituted alkyl group or aryl group, a thio group substituted with a substituted or unsubstituted alkyl group or aryl group, a sulfinyl group substituted with a substituted or unsubstituted alkyl group or aryl group or a sulfonylamino group substituted with a substituted or unsubstituted alkyl group or aryl group, a cyano group, a hydroxy group, a carboxy group or a salt thereof; $X_0$ represents a group capable of accelerating decarboxylation; $B_0$ represents an organic base; and $n_0$ represents 1 when $B_0$ represents a monoacidic base or 2 when B represents a diacidic base.

DETAILED DESCRIPTION OF THE INVENTION

The base precursor represented by the general formula (I) according to the present invention is described in detail in the following.

$R_1$ and $R_2$ each preferably represents a hydrogen atom, a substituted or unsubstituted alkyl group having from 1 to 8 carbon atoms, for example, a methyl group, an isopropyl group or a tert-butyl group, a substituted or unsubstituted aryl group having from 6 to 10 carbon atoms, for example, a phenyl group, a p-chlorophenyl group or a p-methoxyphenyl group, or a substituted or unsubstituted aralkyl group having from 7 to 12 carbon atoms, for example, a benzyl group, a $\beta$-phenethyl group or an $\alpha$-methylbenzyl group.

Examples of substituents for the substituted groups represented by $R_1$ or $R_2$ include an alkoxy group, an alkyl group, a halogen atom, a dialkylamino group, a hydroxy group and an aryloxy group.

$R_3$ and $R_4$ each preferably represents a hydrogen atom, a halogen atom, a substituted or unsubstituted alkyl group having from 1 to 8 carbon atoms, for example, a methyl group, an ethyl group or an isopropyl group, a substituted or unsubstituted aryl group having from 6 to 10 carbon atoms, for example, a phenyl group, a tolyl group, a p-chlorophenyl group or a p-methoxyphenyl group, a substituted or unsubstituted aralkyl group having from 7 to 12 carbon atoms, for example, a benzyl group, a $\beta$-phenethyl group or an $\alpha$-methylbenzyl group, a cyano group, an alkylsulfonyl group or an arylsulfonyl group, for example, a methanesulfonyl group, a benzenesulfonyl group or a toluenesulfonyl group, a substituted or unsubstituted sulfamoyl group, for example, a dimethylsulfamoyl group or a diethylsulfamoyl group, a dialkylphosphoryl group, for example, a diethylphosphoryl group or a diisopropylphosphoryl group, a dialkylphosphinyl group or a diarylphosphinyl group, for example, a diphenylphosphinyl group or a ditolylphosphinyl group, an alkylthio group or an arylthio group, for example, a butylthio group, an octylthio group or a phenylthio group.

Examples of substituents for the substituted groups represented by $R_3$ or $R_4$ include a halogen atom, a cyano group, an alkylsulfonyl group, an alkyl group, an alkoxy group, an acyl group, an acyloxy group and an acylamino group.

The group capable of accelerating decarboxylation represented by $X_0$ is a group capable of accelerating a decarboxylation reaction from the $CO_2H$ group by heating.

As the group capable of accelerating decarboxylation, a releasing group is usually used. The releasing group is a group capable of being released at the same time with the decarboxylation by heating.

For $X_0$, a group derived from a conjugate acid ($X_0H$) having a pKa of about 20 or less, and particularly a pKa of about 15 or less is preferred. Further, a group having an L-value of Swain of about −7 or more, which is an indicator of releasability as described in E. R. Thornton, *Solvolysis Mechanism,* page 165, Ronald Press Co., New York (1967) is preferred.

Specific examples of preferred releasing groups include, for example, an alkoxy group or an aryloxy group, such as a phenoxy group, a 2,4-dichlorophenoxy group or a p-cyanophenoxy group, an acylamino group, such as a trifluoroacetylamino group or a heptafluorobutyroylamino group, a sulfonylamino group, such as a methanesulfonylamino group, a benzenesulfonylamino group or a p-chlorophenylsulfonylamino group, an imido group, such as a succinimido group, a hydantoinyl group or a phthalimido group, an acyloxy group, such as an acetoxy group, a benzoyloxy group or a p-chlorobenzoyloxy group, a halogen atom, such as a chlorine atom, a bromine atom or an iodine atom, an alkylthio group or an arylthio group, such as a phenylthio group, a 1-naphthylthio group or a 2-naphthylthio group, an alkoxycarbonyloxy group or an aryloxycarbonyloxy group, such as an ethoxycarbonyloxy group or a phenoxycarbonyloxy group, a dialkylcarbamoyloxy group, such as a diethylcarbamoyloxy group or a morpholinocarbonyloxy group, and a nitrogen-containing heterocyclic group, such as a 1-pyrazolyl group, a 1-imidazolyl group, a 1-benzimidazolyl group or a 1-benzotriazolyl group.

Further, releasing groups of 2-equivalent couplers useful in a conventional photographic system are preferred examples for $X_0$. Examples of these releasing groups include a 3,5-dimethyl-1-pyrazolyl group, a benzylethoxyhydantoinyl group, a dodecylsuccinimido group and a 1-pyridinium group.

When a releasing group of a 2-equivalent coupler is used as a releasing group in the present invention, $X_0$ is released simultaneously with decarboxylation by heating to form $X_0H$ (or $X_0^-$). When the $X_0H$ thus formed has a photographic effect (e.g., development accelerated effect and development inhibited effect), the base precursors containing such groups are particularly preferred in accordance with the present invention.

Preferred examples of $X_0H$ include sulfonamides, imides and nitrogen-containing heterocyclic compounds.

On the other hand, when $X_0$ is not released but only accelerates the decarboxylation reaction, the effectiveness of the base precursor according to the present invention is still sufficient for practical purposes.

Such a group capable of accelerating decarboxylation is generally a group derived from a conjugate acid having a pKa of about 15 or more. Specific examples of these groups include an ethoxy group, a tert-butoxy group, an acetylamino group, a benzoylamino group.

Moreover, the group represented by $X_0$ may be further substituted with an alkyl group, an alkoxy group, a hydroxy group, a cyano group, an acyloxy group, an acyl group, an acylamino group, a halogen atom, a sulfonyl group or a nitro group.

Of the organic bases represented by $B_0$, those having a pKa of about 7 or more and carbon atoms of 12 or fewer are desirable and those having a pKa of about 10 or more and a boiling point of about 150° C. or higher and having low volatility are preferred. Examples of particularly preferred organic bases include guanidines, cyclic guanidines, amidines, cyclic amidines and tetraalkyl ammonium hydroxides.

Specific examples of preferred organic bases for $B_0$ include the followings, although the present invention is not to be construed as being limited thereto:

dimethylamine, diethylamine, piperidine, piperazine, ethylenediamine, N,N'-dimethylethylenediamine, acetoamidine, diazabicyclononene, diazabicycloundecene, tetramethyl ammonium hydroxide, tetraethyl ammonium hydroxide,

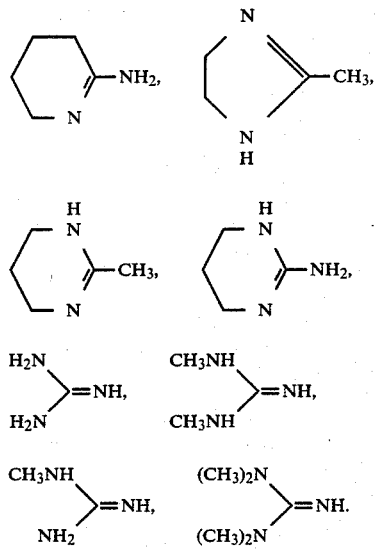

Specific examples of the base precursors which can be preferably used in the present invention are set forth below, although the present invention is not to be construed as being limited thereto.

(1)
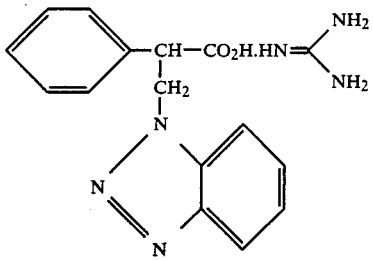
(2)
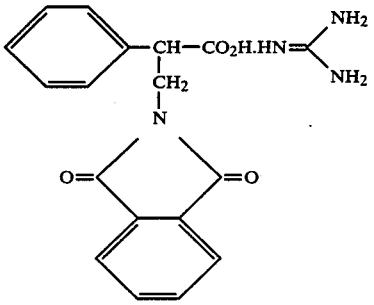
(3)
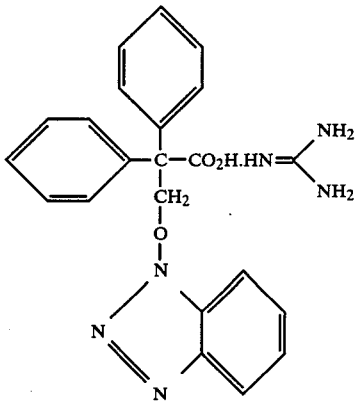
(4)
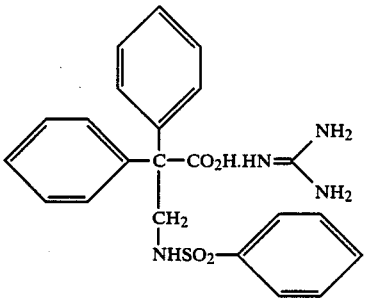
(5)
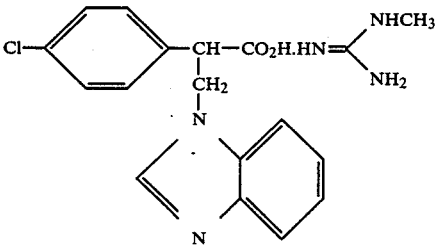
-continued
(6)
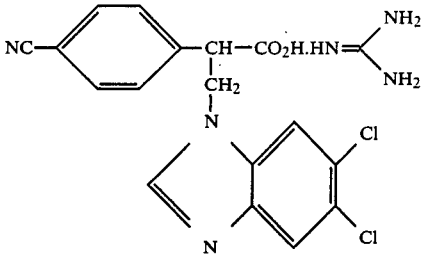
(7)
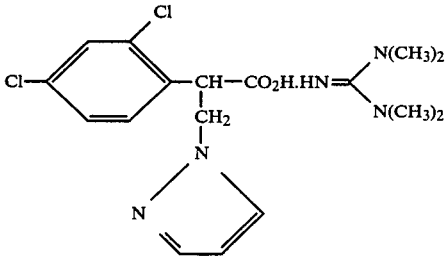
(8)
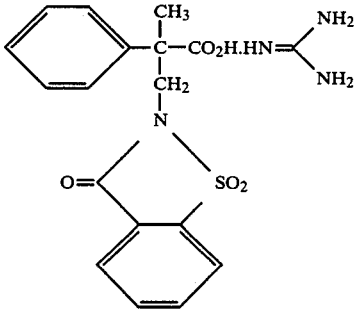
(9)
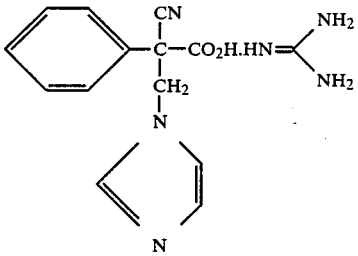
(10)
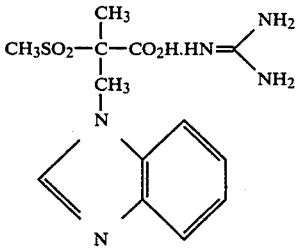

-continued
(11)
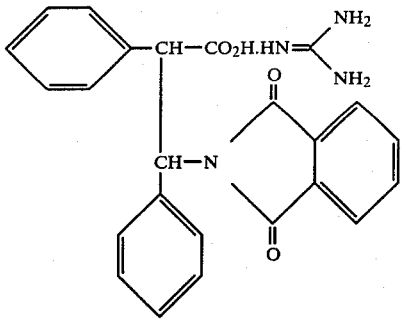
(12)
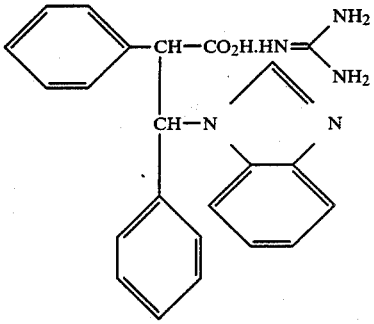
(13)
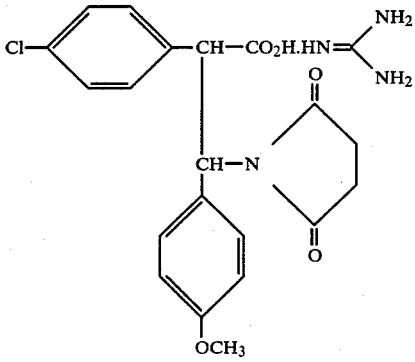
(14)
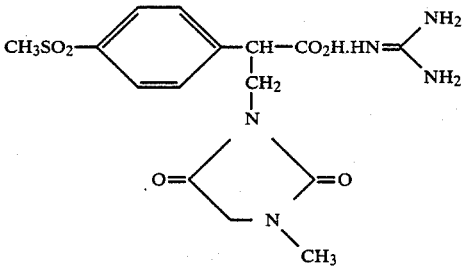
(15)
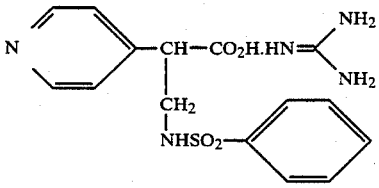
-continued
(16)
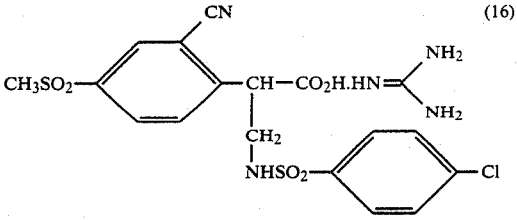
(17)
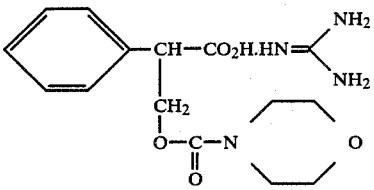
(18)
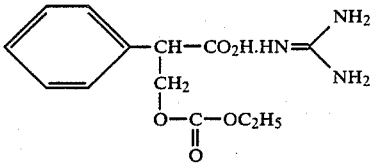
(19)
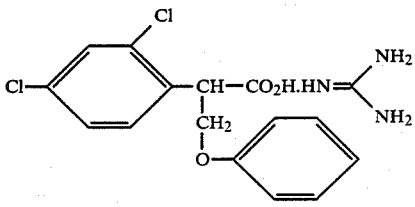
(20)
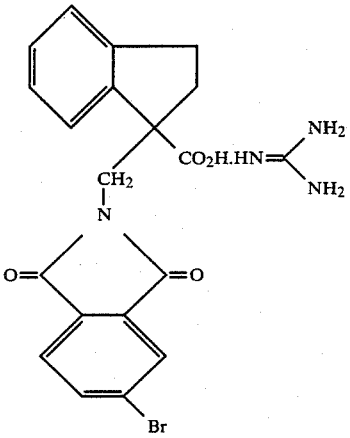
(21)
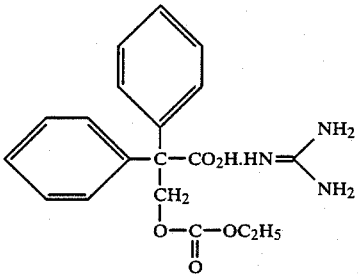

-continued (22)

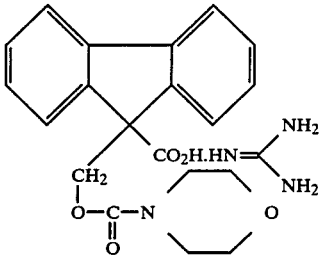

(23)

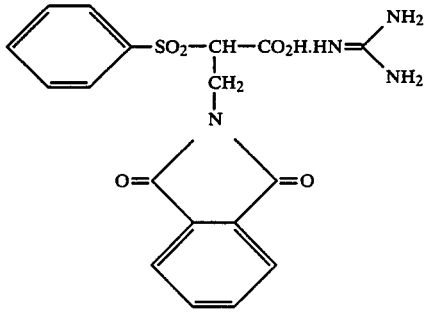

(24)

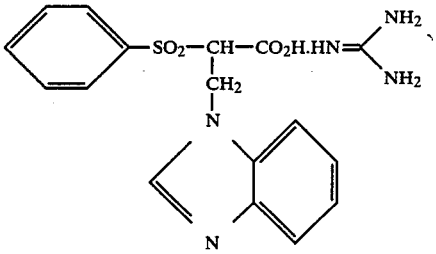

(25)

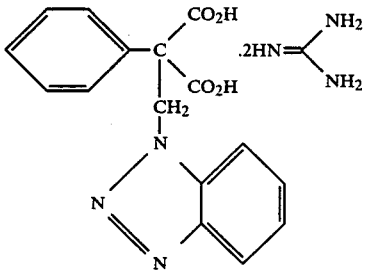

(26)

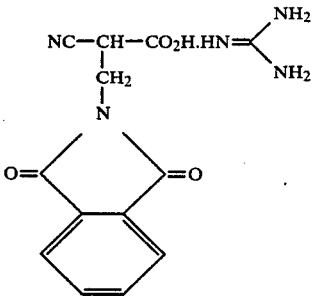

(27)

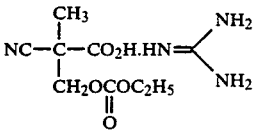

-continued (28)

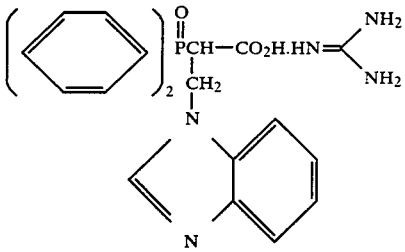

(23) The base precursor according to the present invention can be generally synthesized in the manner illustrated in the following reaction scheme.

(24)

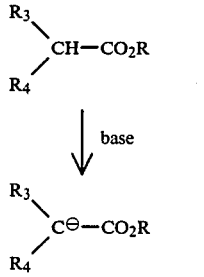

(25)

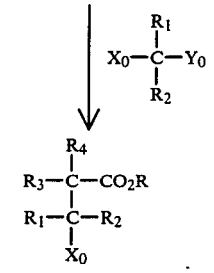

(26)

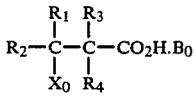

wherein $R_1$, $R_2$, $R_3$, $R_4$, $X_0$ and $B_0$ each has the same meaning as defined above, $Y_0$ represents a halogen atom (for example, a chlorine atom, a bromine atom, an iodine atom, etc.) or a sulfonyloxy group, and R represents a lower alkyl group.

As a base, sodium alkoxide, sodium hydroxide can be generally used.

In the following, a method for synthesis of the base precursor according to the present invention is described with reference to a specific compound, although it will readily be understood by one skilled in the art that other compounds according to the invention can also be synthesized by making appropriate modifications thereof.

SYNTHESIS EXAMPLE

Synthesis of Base Precursor (24)

22.8 g of ethyl phenylsulfonylacetate was dissolved in 200 ml of desiccated acetonitrile, and to the solution was added 11.2 g of potassium tert-butoxide while cooling with ice. After stirring at 5° C. for 10 minutes, 19 g of 1-chloromethylbenzimidazole was added little by little thereto and the mixture was further stirred at room temperature for 2 hours. The acetonitrile was distilled off under a reduced pressure and to the residue was added 200 ml of water. The yellow oily product thus formed was extracted with ethyl acetate. The ethyl acetate solution was washed with water, dried and the solvent was distilled off under a reduced pressure. The residue was purified by silica gel chromatography (eluate: n-hexane/ethyl (acetate=1/1) to obtain 22 g of a compound having the following formula:

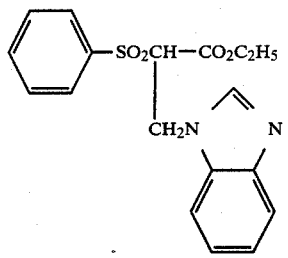

The ester thus obtained was added little by little to 300 ml of 1N aqueous sodium hydroxide solution at room temperature. After stirring for 2 hours, the mixture was adjusted to a pH of 5 with cool diluted hydrochloric acid while cooling with ice. The white precipitate thus obtained was separated by filtration, washed with water and dried to obtain 14.5 g of a free acid of Base Precursor (24).

The free acid thus obtained was dissolved in a mixture of 100 ml of methanol and 20 ml of water and to the solution was gradually added 4.0 g of guanidine carbonate. After stirring the mixture at room temperature for 1 hour, the solvent was distilled off under a reduced pressure at 50° C. or below to obtain 17 g of Base Precursor (24) as white crystals. Melting point: 95 to 107° C. (decomposed).

The base precursor according to the present invention is especially effective when it is employed together with a spectrally sensitized light-sensitive silver halide emulsion, and in particular the degree of increase in image density is particularly large in this case.

The spectral sensitization of silver halide emulsions can be performed using methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes and hemioxonol dyes. Of these dyes, cyanine dyes, merocyanine dyes and complex merocyanine dyes are particularly useful. Any conventionally utilized nucleus for cyanine dyes, such as a basic heterocyclic nucleus, is applicable to dyes useful in the present invention, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus. Furthermore, nuclei formed by condensing alicyclic hydrocarbon rings with these nuclei and nuclei formed by condensing aromatic hydrocarbon rings with these nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus may also be used. The carbon atoms of these nuclei may be substituted.

In merocyanine dyes and complex merocyanine dyes, nuclei having a ketomethylene structure can include 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus or a thiobarbituric acid nucleus.

These sensitizing dyes can be employed individually and can also be employed in combination thereof. A combination of sensitizing dyes is often used, particularly for the purpose of supersensitization.

Useful sensitizing dyes include those described in German Pat. No. 929,080, U.S. Pat. Nos. 2,493,748, 2,503,776, 2,519,001, 2,912,329, 3,656,959, 3,672,897, 3,694,217, 4,025,349 and 4,046,572, British Pat. No. 1,242,588, and Japanese Patent Publication Nos. 14030/69 and 24844/77.

A suitable amount of the sensitizing dye to be used is from about 0.001 g to 20 g, and preferably from about 0.01 g to 2 g, per 100 g of silver contained in the emulsion.

The amount of base precursor according to the present invention used can vary in a broad range. It is suitably used in an amount of about 50% by weight or less, and more preferably in a range from about 0.01% by weight to 40% by weight, based on the amount of a coating layer of the light-sensitive material(dry basis).

Any unit and layer structure can be applied to the light-sensitive material of the present invention. The base precursor may be incorporated into any one of various layers of the light-sensitive material. When a light-sensitive emulsion layer and a layer containing a dye providing substance are separately constructed, the base precursor may be incorporated into any of these layers. Further, it can be incorporated into an interlayer or a protective layer.

Moreover, two or more base precursors according to the present invention can be used.

In the present invention, silver halide as a light-sensitive substance is preferably employed.

The silver halide used in the present invention can be any conventional light-sensitive silver halide, including silver chloride, silver chlorobromide, silver chloroiodide, silver bromide, silver iodobromide, silver chloroiodobromide and silver iodide.

Any conventional process for preparing those silver halides can be used, such as a typical method of preparing silver iodobromide by first adding a silver nitrate solution to a potassium bromide solution to form silver bromide particles and then adding potassium iodide to the mixture.

Two or more silver halides in which the particle size and/or halogen composition are different from each other may be used in combination.

The average particle size of the silver halide used in the present invention is preferably from about 0.001 μm to 10 μm and more preferably from about 0.001 μm to 5 μm.

The silver halide used in the present invention may be unsensitized or chemically sensitized with a conventional chemical sensitizing agent such as compounds of sulfur, selenium or tellurium, or compounds of gold, platinum, palladium, rhodium or iridium, a reducing agent such as tin halide, or a combination thereof. The details of suitable sensitization methods are described in T. H. James, *The Theory of the Photographic Process,* pages 149 to 169 (4th Ed. 1977).

A suitable coating amount of the light-sensitive silver halide according to the present invention is from about 1 mg to 10 g/m$^2$ calculated as silver.

In a particularly preferred embodiment of the heat developable light-sensitive material according to the present invention, an organic silver salt oxidizing agent is used together with silver halide. The organic silver salt oxidizing agent is a silver salt which forms a silver image by reacting with the hereinafter described reductive dye providing substance or with optional reducing agents present together with the image forming substances, when it is heated to a temperature of above about 80° C. and preferably above about 100° C. in the presence of exposed silver halide. Combined use of such an organic silver salt oxidizing agent, the light-sensitive material which provides higher color density can be obtained.

The silver halide used in conjunction with an organic silver salt oxidizing agent does not necessarily contain pure silver iodide crystal in the case of using the silver halide alone. Any silver halide which is known in the art can be used.

Examples of such organic silver salt oxidizing agents include those described in U.S. Pat. No. 4,500,626, and specifically include the following.

A silver salt of an organic compound having a carboxy group can be used, including a silver salt of an aliphatic carboxylic acid and a silver salt of an aromatic carboxylic acid.

In addition, a silver salt of a compound containing a mercapto group or a thione group or a derivative thereof can be used.

Further, a silver salt of a compound containing an imino group can be used, including a silver salt of benzotriazole and a derivative thereof described in Japanese Patent Publication No. 30270/69 and U.S. Pat. No. 3,635,719, e.g., a silver salt of benzotriazole, a silver salt of an alkyl-substituted benzotriazole such as a silver salt of methylbenzotriazole, a silver salt of a halogen-substituted benzotriazole such as a silver salt of 5-chlorobenzotriazole, a silver salt of carboimidobenzotriazole such as a silver salt of butylcarboimidobenzotriazole, a silver salt of 1,2,4-triazole or 1-H-tetrazole as described in U.S. Pat. No. 4,220,709, a silver salt of carbazole, a silver salt of saccharin, a silver salt of imidazole and an imidazole derivative.

Moreover, a silver salt as described in *Research Disclosure,* Vol. 170, No. 17029 and an organic metal salt such as copper stearate can be used as organic metal salt oxidizing agents in the present invention.

Methods of preparing these silver halide and organic silver salt oxidizing agents and methods of blending them are described in *Research Disclosure,* No. 17029, Japanese Patent Application (OPI) Nos. 42529/76, 13224/74 and 17216/75 and U.S. Pat. Nos. 3,700,458 and 4,076,539.

A suitable coating amount of the light-sensitive silver halide and the organic silver salt oxidizing agent employed in the present invention is a total of from about 50 mg/m$^2$ to 10 g/m$^2$ calculated as silver.

In the present invention, a wide variety of image forming substances can be used in addition to silver as an image forming substance.

For instance, couplers capable of forming color images by bonding to oxidation products of developing agents employed in conventional liquid development processing can be used in the present invention, with specific examples including magenta couplers such as 5-pyrazolone couplers, pyrazolobenzimidazole couplers, cyanoacetylcumarone couplers and open chain acylacetonitrile couplers, yellow couplers such as acylacetamide couplers (e.g., benzoylacetanilides and pivaloylacetanilides), and cyan couplers such as naphthol couplers and phenol couplers.

It is generally desirable that these couplers should be rendered nondiffusible by a hydrophobic group (i.e., a "ballast group") in their molecules, or that the couplers should be polymeric couplers. The couplers may be either 4-equivalent or 2-equivalent with respect to silver ion. Further, these couplers may be colored couplers having a color correction effect, or couplers capable of releasing development inhibitors upon development (i.e., "DIR couplers").

In addition, dyes which can produce positive color images using light-sensitive silver dye bleach processes, for example, dyes described in *Research Disclosure,* pages 30–32, RD-14433 (April, 1976), *Research Disclosure,* pages 14–15, RD-15227 (December, 1976), and U.S. Pat. No. 4,235,957, and leuco dyes described in U.S. Pat. Nos. 3,985,565 and 4,022,617, can be used.

Also, dyes into which nitrogen-containing heterocyclic groups are introduced described in *Research Disclosure,* pages 54–58, RD-16966 (May, 1978) can be used.

Moreover, dye providing substances described in European Pat. Nos. 67,455 and 79,056, West German Pat. No. 3,217,853, which release mobile dyes by a coupling reaction with reducing agents oxidized by a redox reaction with silver halide or organic silver salt oxidizing agents under high temperatures, and dye providing substances described in European Pat. Nos. 66,282 and 76,492, West German Pat. No. 3,215,485, and Japanese Patent Application (OPI) Nos. 154445/84 and 152440/84, which undergo a redox reaction with silver halide or organic silver salt oxidizing agents under high temperatures, and release mobile dyes as a result of this reaction, can be used.

Dye providing substances which can be used in the above described processes are preferably represented by the following formula (CI):

$$(\text{Dye}-\text{X})_q-\text{Y} \qquad \text{(CI)}$$

wherein Dye represents a dye which becomes mobile when it is released from the molecule of the compound represented by the formula (CI); X represents a simple bond or a connecting group; q represents 1; and Y represents a group which releases Dye in correspondence or countercorrespondence to light-sensitive silver salts having a latent image distributed imagewise, the diffusibility of a dye released being different from that of the compound represented by $(\text{Dye}-\text{X})_q-\text{Y}$.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes. These dyes can also be used in a color-shifted form having temporarily shorter wavelengths, the original color of which is recoverable in development processing.

More specifically, dyes described in European Pat. No. 76,492 can be utilized.

Examples of the connecting group represented by X include —NR— (wherein R represents a hydrogen atom, an alkyl group, or a substituted alkyl group), $—SO_2—$, —CO—, an alkylene group, a substituted alkylene group, a phenylene group, a substituted phenylene group, a naphthylene group, a substituted naphthylene group, —O—, —SO—, or a group containing two or more of the foregoing groups in combination.

In the following, preferred embodiments of Y in formula (CI) are described in greater detail.

In one embodiment, Y is selected so that the compound represented by the general formula (CI) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (CII) is illustrated for Y.

(CII)

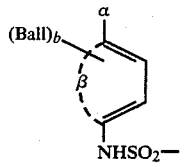

wherein

β represents non-metallic atoms necessary for forming a benzene ring, which may optionally be condensed with a carbon ring or a hetero ring to form, for example, a naphthalene ring, a quinoline ring, a 5,6,7,8-tetrahydronaphthalene ring, a chroman ring or the like;

α represents a group of $—OG^{11}$ or $—NHG^{12}$ (wherein $G^{11}$ represents hydrogen or a group which forms a hydroxyl group upon being hydrolyzed, and $G^{12}$ represents hydrogen, an alkyl group containing 1 to 22 carbon atoms or a hydrolyzable group);

Ball represents a ballast group; and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

(CIII)

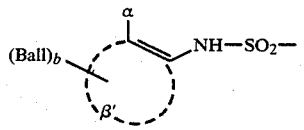

wherein Ball, α and b are the same as defined with (CII), β' represents atoms necessary for forming a carbon ring (e.g., a benzene ring which may be condensed with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16131/81, 16130/81, 4043/82 and 650/82 and U.S. Pat. No. 4,053,312.

Further examples of Y suited for this type of compound are those represented by the following formula (CIV):

(CIV)

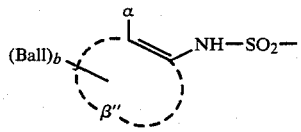

wherein Ball, α and b are the same as defined with the formula (CII), and β'' represents atoms necessary for forming a hetero ring such as a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

(CV)

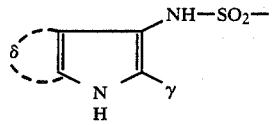

wherein γ preferably represents hydrogen, a substituted or unsubstituted alkyl, aryl or heterocyclic group, or $—CO—G^{21}$; $G^{21}$ represents $—OG^{22}$, $—SG^{22}$ or

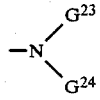

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and δ represents a residue necessary for completing a condensed benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

(CVI)

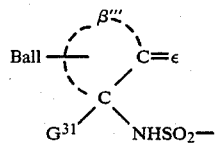

wherein Ball is the same as defined with the formula (CII); ε represents an oxygen atom or $=NG^{32}$ (wherein $G^{32}$ represents hydroxyl or an optionally substituted amino group) (examples of $H_2N—G^{32}$ to be used for forming the group of $=NG^{32}$ including hydroxylamine, hydrazines, semicarbazides, thiosemicarbazides, etc.);

$\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

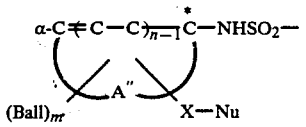

(CVII)

wherein $\alpha$ represents $OR^{41}$ or $NHR^{42}$; $R^{41}$ represents hydrogen or a hydrolyzable component; $R^{42}$ represents hydrogen, an alkyl group containing 1 to 50 carbon atoms or a hydrolyzable group; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above described formula (CII). Specific examples of this type of Y are described in Japanese Patent Application (OPI) No. 20735/82.

As still further type of examples represented by the formula (CI), there are dye providing nondiffusible substances which release a diffusible dye in the presence of a base as a result of self cyclization or the like but which, when reacted with an oxidation product of a developing agent, substantially never release the dye.

Examples of Y effective for this type of compound are those which are represented by the formula (CVIII):

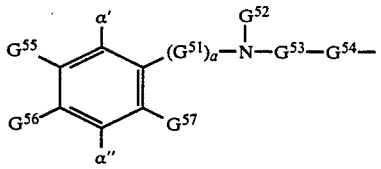

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

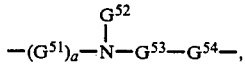

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

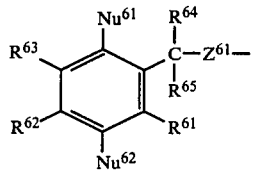

(CIX)

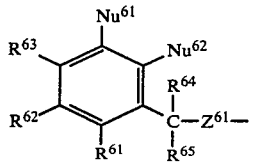

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a condensed ring together with the rest of the molecule, or $R^{62}$ and $R^{63}$ may form a condensed ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of Y are described in Japanese Patent Application (OPI) Nos. 69033/78 and 130927/79.

Further examples of Y suited for this type of compound are those which are represented by the formula (CXI):

(CXI)

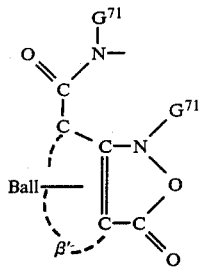

wherein Ball and $\beta''$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by the formula (CXII):

(CXII)

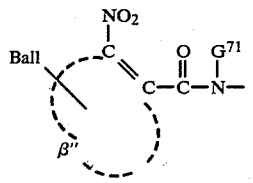

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

(CXIII)

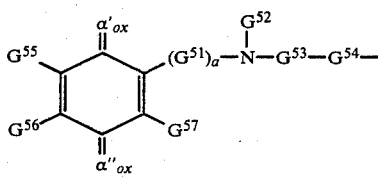

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$ $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIV-A) and (CXIV-B):

(CXIV-A)

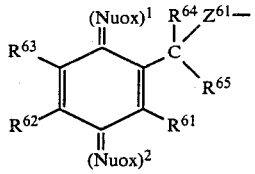

(CXIV-B)

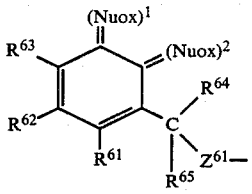

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIV-A) and (CXIV-B) describe electron donors to be used in combination.

As still further different type of compound represented by the general formula (CI), there are illustrated LDA compounds (Linked Donor Acceptor Compounds). These compounds are dye providing nondiffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula (CXV) (specific examples thereof being described in Japanese Patent Application (OPI) No. 60289/83):

(CXV)

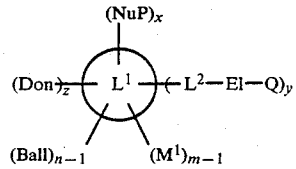

wherein n, x, y and z each represents 1 or 2, m represents an integer of 1 or more; Don represents a group containing an electron donor or its precursor moiety; $L^1$ represents an organic group linking Nup to —El—Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance nondiffusible, and is preferably a group containing a $C_{8-32}$ hydrophobic group. Such organic ballast group is bound to the dye providing substance directly or through a linking group (e.g., an imino bond, an ether bond, a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

Specific examples of dye image forming substances which can be used in the present invention are described in the patents cited hereinbefore. Since length prevents illustrating all preferred examples thereof, only a portion thereof is described hereinafter. Specific examples of the dye providing substances represented by general formula (CI) are set forth below.

CI-1

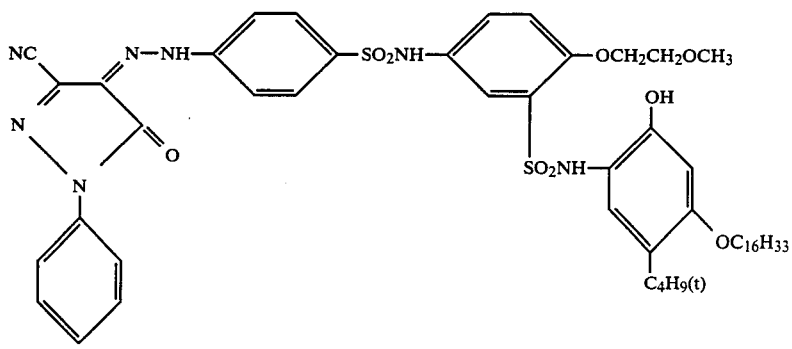

CI-2

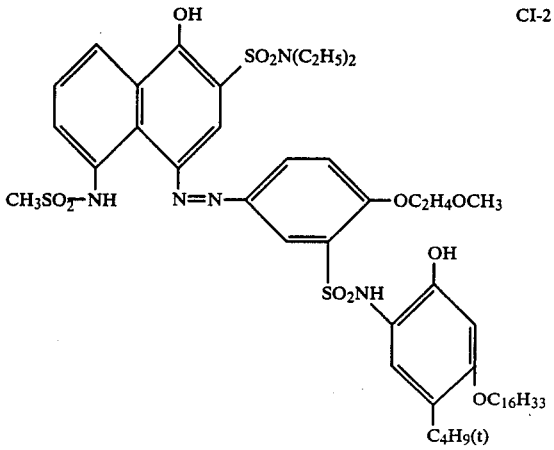

CI-3

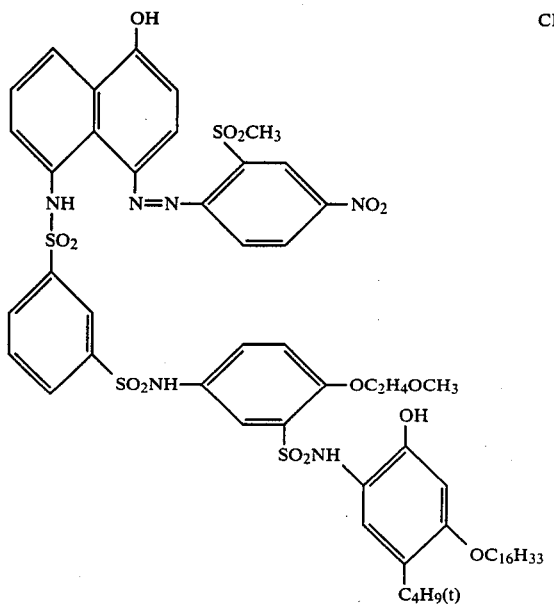

CI-4

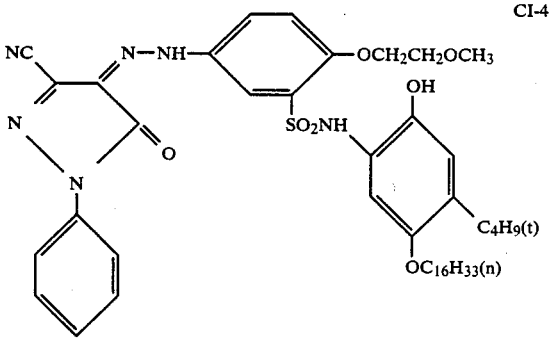

-continued
CI-5
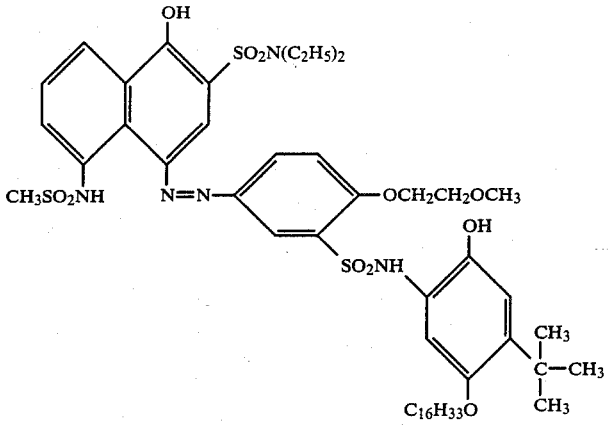
CI-6
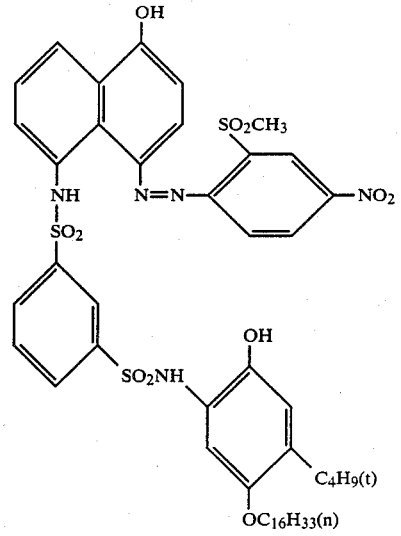
CI-7
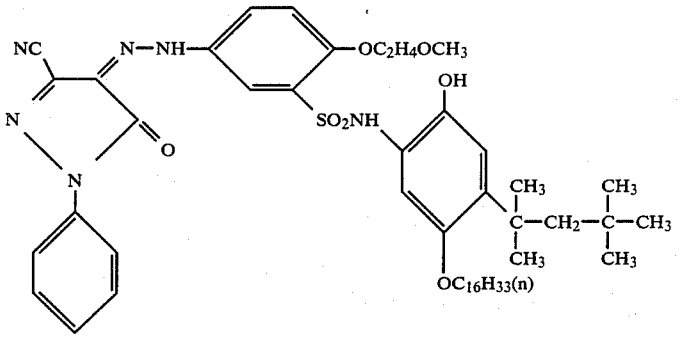
CI-8
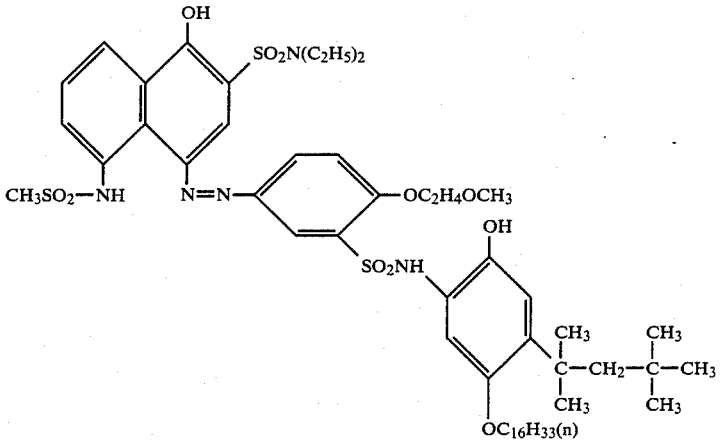

-continued
CI-9
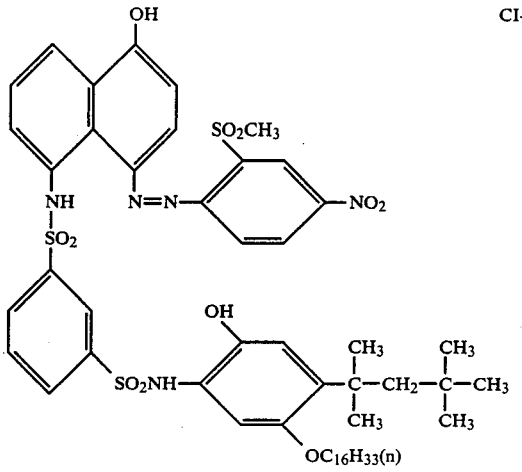
CI-10
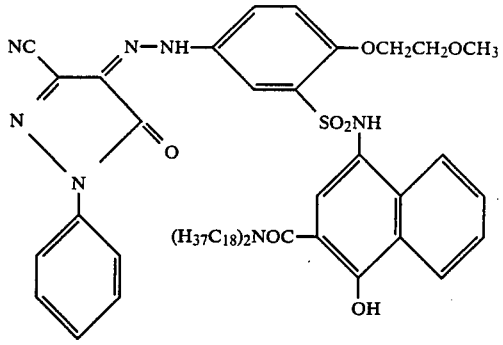
CI-11
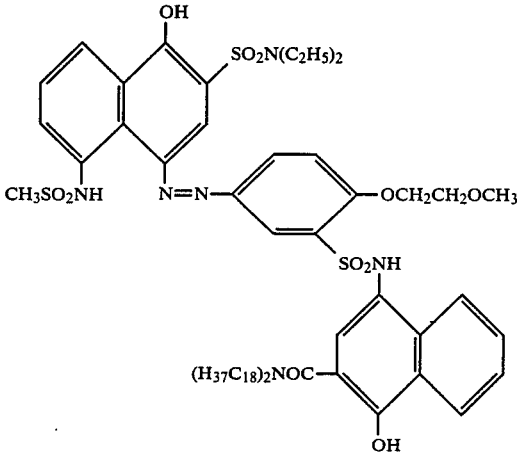
CI-12
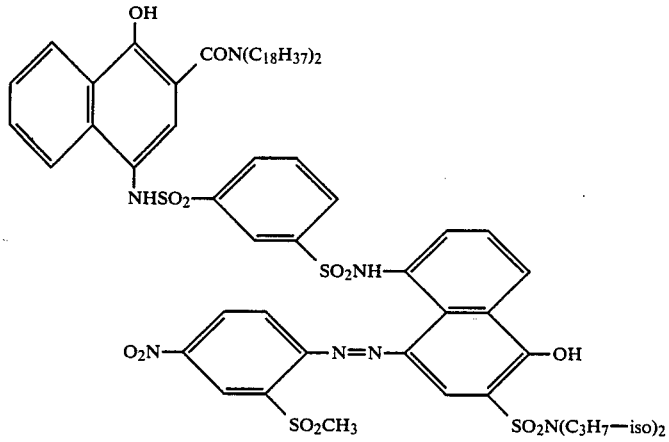

-continued
CI-13
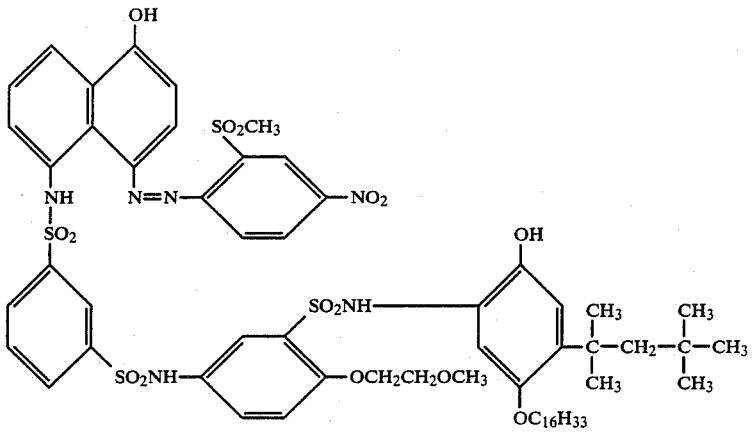
CI-14
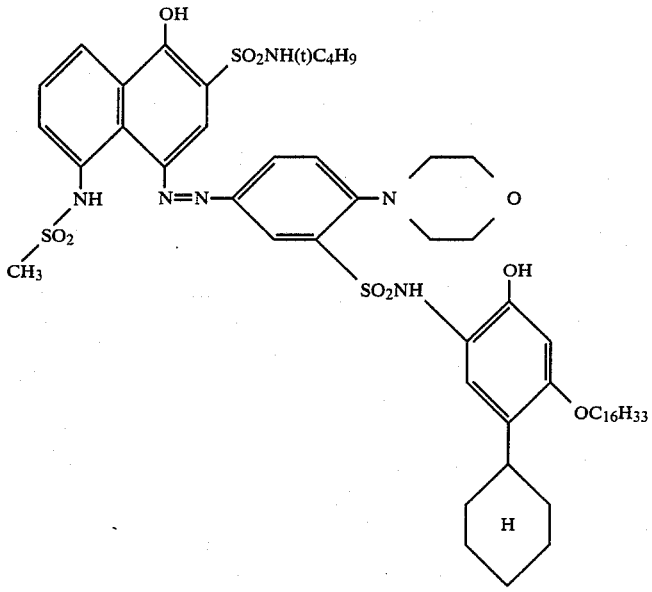
CI-15
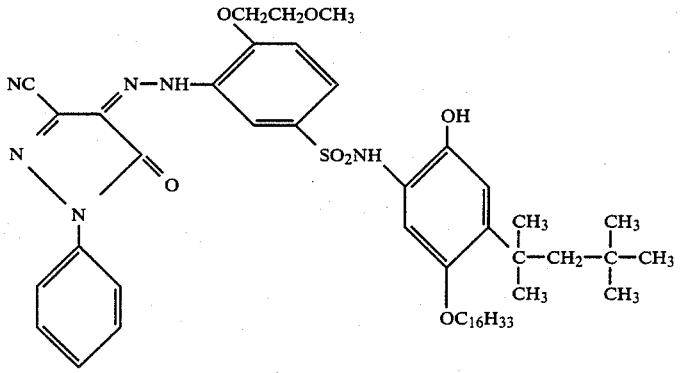

-continued

CI-16

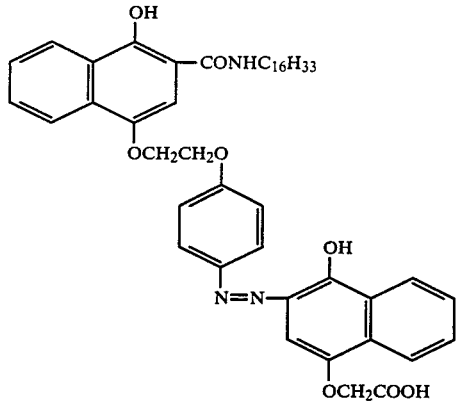

The above described compounds are only given as examples and the present invention should not be construed as being limited thereto.

Many of the above described substances form an imagewise distribution of mobile dyes corresponding to exposure in a light-sensitive material by heat development, and methods for transferring these image dyes into a dye fixing material (so-called diffusion transfer) to produce images are described in the above described patents and Japanese Patent Application (OPI) Nos. 168439/84 and 182447/84.

The dye providing substance used in the present invention can be introduced into a layer of the light-sensitive material by known methods such as the method as described in U.S. Pat. No. 2,322,027, such as by using an organic solvent having a high boiling point or an organic solvent having a low boiling point as described in the Examples.

For example, the dye providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used. An amount of high boiling point organic solvent used in the present invention is 10 g or less, and preferably 5 g or less, per gram of the dye providing substance.

In the present invention, if necessary, a reducing agent may be used. The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

In the present invention various dye releasing activators can be used. These dye releasing activators of the present invention are compounds which are basic and are capable of accelerating development, or so-called nucleophilic compounds. Namely, bases or base precursors are used.

Although base precursors of the present invention can be used as a dye releasing activator, other bases or base precursors can also be incorporated.

The dye releasing activator can be incorporated in the light-sensitive material or a dye fixing material. In the case that the dye releasing activator is incorporated in the light-sensitive material, it is advantageous to use a base precursor.

In the present invention various development stopping agents can be used in order to always obtain constant image regardless of any changes of processing temperature and processing time in heat development.

These development stopping agents mean compounds capable of neutralizing a base or capable of reacting with a base to reduce the basicity in layer immediately after completion of appropriate development. In the concrete, acid precursors releasing an acid by heating, or compounds reacting with a base coexisting by heating are used as a development stopping agent. For example, the embodiments of the acid precursor include oxime esters as described in Japanese Patent Application Nos. 216928/83 and 48305/84, and compounds releasing an acid due to Lossen rearrangement as described in Japanese Patent Application No. 85834/84. The compounds reacting with a base by heating are described in Japanese Patent Application No. 85836/84.

When base precursors are used, the most excellent effect of a development stopping agent is obtained. In that case, the mole ratio of a base precursor/an acid precursor is from 1/20 to 20/1, and preferably from 1/5 to 5/1.

The binder which can be used in the present invention can be employed alone or in a combination thereof. A hydrophilic binder can be used as the binder according to the present invention. The typical hydrophilic binder is a transparent or translucent hydrophilic binder, examples of which include a natural substance, for example, protein such as gelatin, a gelatin derivative, etc., a polysaccharide such as starch, gum arabic, a cellulose derivative, etc., and a synthetic polymer, for example, a water-soluble polyvinyl compound such as polyvinyl alcohol, polyvinylpyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trichloroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

Furthermore, it is also preferred to use azolthioether and blocked azoline thione compound as described in Belgian Patent No. 768,071, 4-aryl-1-carbamyl-2-tetrazoline-5-thione compound as described in U.S. Pat. No. 3,893,859, and compounds as described in U.S. Pat. Nos. 3,839,041, 3,844,788 and 3,877,940.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

The above described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above described manner, migration of additives among constituent layers of a heat developable photosensitive material can be reduced. Therefore, such distribution of additives is of advantage to some cases.

The heat developable photosensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include sunlight, flash lamp, strobo light, tungsten lamps, mercury lamps, halogen lamps such as iodine lamps, xenon lamps, laser light sources, CRT light sources, plasma light sources, fluorescent tubes and light emitting diodes, etc.

In the present invention, after the heat developable color photographic material is exposed to light, the resulting latent image can be developed by heating the whole material to a suitably elevated temperature.

As the heating means, a simple heat plate, iron, heat roller, heat generator utilizing carbon or titanium white, etc., or analogues thereof may be used.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used alone or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, antihalation and anti-irradiation dyes, hardeners, mordants and so on, are those described in U.S. Pat. No. 4,500,626, 4,478,927, 4,463,079, and Japanese Patent Application Nos. 28928/83 (corresponding to U.S. patent application Ser. No. 582,655, filed on Feb. 23, 1984) and U.S. Pat. No. 4,503,137. Methods for the exposure and so on cited in the above described patents can be employed in the present invention also.

According to the present invention, an image having a high density can be produced by heat development in a short time because the compound represented by the general formula (I) is incorporated into the heat developable light-sensitive material as a base precursor. Further, the heat developable light-sensitive material exhibits little change in photographic properties after a lapse of time and has extremely good shelf life.

The present invention will be explained in greater detail with reference to the following examples, but the present invention should not be construed as being limited thereto. Unless otherwise indicated, all parts, percents and ratios are by weight.

EXAMPLE 1

Method for Preparation of Silver Iodobromide Emulsion 40 g of gelatin and 26 g of potassium bromide (KBr) were dissolved in 3,000 ml of water and the solution was maintained at 50° C. with stirring. A solution of 34 g of silver nitrate dissolved in 200 ml of water and 200 ml of a solution of 0.02 g of Dye I described below dissolved in 300 ml of methanol were simultaneously added to the above prepared solution over a 10 minute period. Then, a solution of 3.3 g of potassium iodide (KI) dissolved in 100 ml of water was added over a 2 minute period. The thus prepared silver iodobromide emulsion was precipitated, and excess salts were removed. It was then adjusted to a pH of 6.0, and 400 g of a silver iodobromide emulsion was obtained.

Dye I:

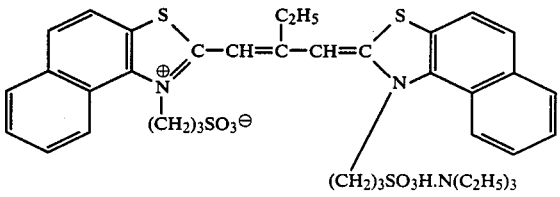

Method for Preparation of Dispersion of Coupler in Gelatin

A mixture of 5 g of 2-dodecylcarbamoyl-1-naphthol, 0.5 g of sodium 2-ethylhexyl sulfosuccinate, 2.5 g of tricresyl phosphate (TCP) and 30 ml of ethyl acetate was dissolved. This solution was mixed with 100 g of a 10 wt % aqueous solution of gelatin with stirring and the mixture was dispersed by means of a homogenizer at 10,000 rpm for 10 minutes.

A coating solution having the composition shown below was coated on a polyethylene terephthalate support at a wet layer thickness of 60 μm and dried to prepare a light-sensitive material.

| | | |
|---|---|---|
| (1-a) | Silver iodobromide emulsion | 10 g |
| (1-b) | Gelatin dispersion of coupler | 3.5 g |
| (1-c) | Base Precursor (24) according to the present invention | 0.32 g |
| (1-d) | Gelatin (10 wt % aq. soln.) | 5 g |
| (1-e) | Solution containing 0.2 g of 2,6-dichloro-p-aminophenol dissolved in 17 ml of water | |

The light-sensitive material thus obtained was exposed imagewise at 2,000 lux for 5 seconds using a tungsten lamp and then uniformly heated for 20 seconds on a heat block which had been heated at 150° C., whereby a negative cyan color image was obtained.

The density of the cyan color image was measured using a Macbeth transmission densitometer (TD-504). The minimum density (Dmin) was 0.24 and the maximum density (Dmax) was 2.05.

From these results it will be understood that the compound according to the present invention provides a high density color image.

EXAMPLE 2

The same silver iodobromide emulsion as described in Example 1 and the following dispersion of a dye providing substance were employed.

Method for Preparation of Dispersion of Dye Providing Substance

A mixture of 5 g of Dye Providing Substance CI-2 shown below, 0.5 g of sodium 2-ethylhexyl sulfosuccinate, as a surface active agent, 5 g of tricresyl phosphate (TCP) and 30 ml of ethyl acetate was dissolved by heating at about 60° C. to prepare a solution. This solution was mixed with 100 g of a 10 wt % aqueous solution of gelatin with stirring and the mixture was dispersed by means of a homogenizer at 10,000 rpm for 10 minutes.

Dye Providing Substance CI-2:

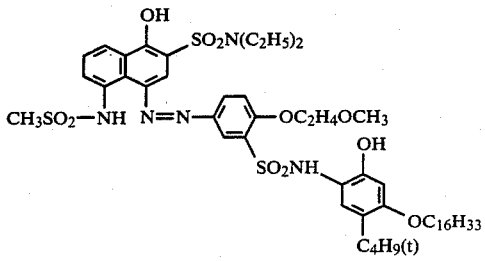

A light-sensiitve coating solution was prepared as follows.

| | | |
|---|---|---|
| (2-a) | Light-sensitive silver iodobromide emulsion (same as described in Example 1) | 25 g |
| (2-b) | Dispersion of Dye Providing Substance CI-2 | 33 g |
| (2-c) | 5 vol % Aqueous solution of a compound having the following formula: | 10 ml |

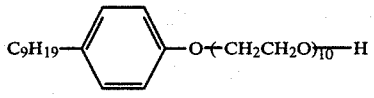

| | | |
|---|---|---|
| (2-d) | 10 wt % Aqueous solution of a compound having the following formula: $H_2NSO_2N(CH_3)_2$ | 4 ml |
| (2-e) | Base Precursor (24) according to the present invention | 3.1 g |
| (2-f) | Water | 20 ml |

The above components (2-a) to (2-f) were mixed and dissolved by heating and the mixture was coated on a polyethylene terephthalate film at a wet layer thickness of 30 μm and dried. This light-sensitive material is designated Sample A.

The light-sensitive material thus obtained was exposed imagewise at 2,000 lux for 10 seconds using a tungsten lamp and then uniformly heated for 20 seconds on a heat block at 150° C.

For comparison, Samples B, C and D were prepared by the same procedure as described for Sample A except that 1.8 g of guanidine trichloroacetate, 2.1 g of guanidine phenylsulfonyl acetate and 2.2 g of guanidine 3-sulfamoylphenylsulfonyl acetate were used in place of Base Precursor (24) according to the present invention as component (2-e), respectively.

An image receiving material having an image receiving layer was prepared as follows:

10 g of poly(methyl acrylate-co-N,N,N-trimethyl-N-vinylbenzylammonium chloride) (molar ratio of methyl acrylate/vinylbenzylammonium chloride: 1/1) was dissolved in 200 ml of water and then uniformly mixed with 100 g of a 10 wt % aqueous solution of lime-processed gelatin. The resulting mixture was uniformly coated at a wet layer thickness of 90 μm on a paper support laminated with polyethylene with titanium dioxide dispersed therein. The thus prepared material was dried and then used as an image receiving material.

The above described image receiving material was soaked in water and then superimposed on each of the above heated light-sensitive materials, i.e., Samples A, B, C and D, so that their coated layers were in contact with each other.

After heating for 6 seconds on a heat block maintained at 80° C., the image receiving material was separated from the light-sensitive material, whereupon a negative magenta color image was obtained in the image receiving material.

The maximum density (Dmax) and the minimum density (Dmin) of the negative color image were measured using a Macbeth reflection densitometer (RD-519).

Further, Samples A, B, C and D were preserved at 60° C. for 2 days and then subjected to the same procedure as described above to obtain negative magenta color images. The maximum density (D'max) and the minimum density (D'min) of these images were measured in the same manner as described above.

These results are shown in Table 1.

TABLE 1

| Sample No. | Dmax | Dmin | D'max | D'min |
|---|---|---|---|---|
| A (Invention) | 1.98 | 0.20 | 1.99 | 0.26 |
| B (Comparison) | 2.14 | 0.58 | Fog in whole area | |
| C (Comparison) | 1.28 | 0.16 | 1.33 | 0.20 |
| D (Comparison) | 1.45 | 0.15 | 1.49 | 0.27 |

From the results shown in Table 1, it is understood that the base precursor according to the present invention provides both a high maximum density and a low minimum density, and has good shelf life.

EXAMPLE 3

The same procedures as described in Example 2 were repeated except using the base precursors according to the present invention shown in Table 2. The results obtained are shown in Table 2.

TABLE 2

| Sample No. | Base Precursor | Amount Added | Dmax | Dmin | D'max | D'min |
|---|---|---|---|---|---|---|
| E | (4) | 3.4 g | 2.10 | 0.25 | 2.04 | 0.29 |
| F | (6) | 3.2 g | 2.08 | 0.21 | 2.02 | 0.34 |
| G | (11) | 3.2 g | 2.01 | 0.23 | 1.98 | 0.28 |
| H | (13) | 3.4 g | 2.05 | 0.18 | 2.02 | 0.26 |

From the results shown in Table 2, it is understood that the base precursors according to the present invention provide both a high maximum density and a low minimum density, and have good shelf life.

EXAMPLE 4

In the following, an example using an organic silver salt oxidizing agent is illustrated.

Method for Preparation of Silver Benzotriazole Emulsion 28 g of gelatin and 13.2 g of benzotriazole were dissolved in 3,000 ml of water and the solution was maintained at 40° C. with stirring. A solution of 17 g of silver nitrate dissolved in 100 ml of water was added to the above prepared solution over a 2 minute period. The thus prepared silver benzotriazole emulsion was precipitated, and excess salts were removed. It was then adjusted to a pH of 6.0, and 400 g of a silver benzotriazole emulsion was obtained.

Using the above described silver benzotriazole emulsion, the following light-sensitive coating composition was prepared.

| | | |
|---|---|---|
| (4-a) | Silver iodobromide emulsion (same as described in Example 1) | 20 g |
| (4-b) | Silver benzotriazole emulsion | 10 g |
| (4-c) | Dispersion of dye providing substance (same as described in Example 2) | 33 g |
| (4-d) | 5 vol % Aqueous solution of a compound having the following formula: 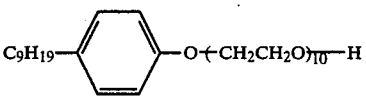 | 10 ml |
| (4-e) | 10 wt % Aqueous solution of a compound having the following formula: $H_2NSO_2N(CH_3)_2$ | 4 ml |
| (4-f) | Base Precursor (24) according to the present invention | 3.4 g |
| (4-g) | Dispersion of acid precursor in gelatin described below | 8 ml |
| (4-h) | Water | 12 ml |

The dispersion of acid precursor in gelatin described in (4-g) above was prepared in the following manner.

10 g of the compound shown below was added to 100 g of a 1 wt % aqueous solution of gelatin and the mixture was pulverized in a mill containing 100 g of glass beads with an average diameter of about 0.6 mm for 10 minutes. The glass beads were separated by filtration, and a dispersion of acid precursor in gelatin was obtained.

Acid Precursor:

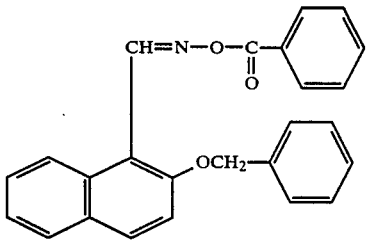

The above components (4-a) to (4-h) were mixed and the same procedure described in Example 2 was followed to prepare a light-sensitive material and then the light-sensitive material was processed and evaluated in the same manner as described in Example 2. The results thus obtained are shown in Table 3.

TABLE 3

| Sample | Maximum Density | Minimum Density |
|---|---|---|
| A' containing Base Precursor (24) (Invention) | 2.12 | 0.20 |
| B' containing guanidine trichloroacetate (Comparison) | 2.33 | 0.61 |
| C' containing guanidine phenylsulfonylacetate (Comparison) | 1.47 | 0.19 |

From the results shown in Table 3, it is understood that the base precursor according to the present invention provides both a high miximum density and a low minimum density.

Further, Samples A', B' and C' were preserved at 60° C. for 2 days and then subjected to the same procedure as described above. The minimum density and the maximum density of Samples A' were 0.29 and 2.16 and those of Sample C' were 0.20 and 1.52. Sample B' exhibited fog in whole area. From these results, it is apparent that the sample according to the present invention has good shelf life.

EXAMPLE 5

Method for Preparation of Silver Benzotriazole Emulsion Containing Light-Sensitive Silver Bromide 10 g of gelatin and 6.5 g of benzotriazole were dissolved in 1,000 ml of water and the solution was maintained at 50° C. with stirring. A solution of 8.5 g of silver nitrate dissolved in 100 ml of water was added to the above prepared solution over a 2 minute period. Then, a solution of 1.2 g of potassium bromide dissolved in 50 ml of water was added over a 2 minute period. The thus prepared emulsion was precipitated and excess salts were removed. It was then adjusted to a pH of 6.0, and 200 g of a silver benzotriazole emulsion containing silver bromide was obtained.

Method for Preparation of Dispersion of Dye Providing Substance in Gelatin

A mixture of 10 g of Dye Providing Substance CI-16 shown below, 0.5 g of sodium 2-ethylhexyl sulfosuccinate, as a surface active agent, 4 g of tricresyl phosphate (TCP) and 20 ml of cyclohexanone was dissolved by heating at about 60° C. to prepare a uniform solution. This solution was mixed with 100 g of a 10 wt % aqueous solution of lime-processed gelatin with stirring and the mixture was dispersed by means of a homogenizer at 10,000 rpm for 10 minutes.

Dye Providing Substance CI-16:

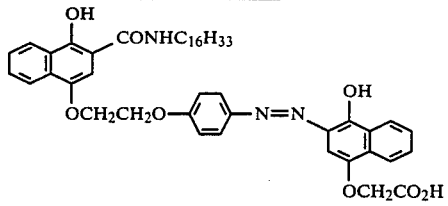

A light-sensitive coating solution was prepared as follows:

| | | |
|---|---|---|
| (5-a) | Silver benzotriazole emulsion containing light-sensitive silver bromide | 10 g |
| (5-b) | Dispersion of Dye Providing Substance CI-16 | 3.5 g |
| (5-c) | Base Precursor (24) according to the present invention | 0.32 g |
| (5-d) | Gelatin (10 wt % aq. soln.) | 5 g |
| (5-e) | Solution containing 200 mg of 2,6-dichloro-4-aminophenol dissolved in 4 ml of methanol | |

The above components (5-a) to (5-e) were mixed and dissolved by heating and the mixture was coated on a polyethylene terephthalate film having a thickness of 180 μm at a wet layer thickness of 30 μm and dried.

The light-sensitive material thus obtained was exposed imagewise at 2,000 lux for 10 seconds using a tungsten lamp and then uniformly heated for 20 seconds on a heat block at 150° C.

The same procedure as described in Example 2 was conducted using the image receiving material as described in Example 2, and a negative magenta color image was obtained in the image receiving material.

The density of the negative image was measured by means of a Macbeth reflection densitometer (RD-519). The maximum density was 2.12 and the minimum density was 0.24. These results demonstrate that the compound according to the present invention exhibits excellent effect (i.e., a high maximum density and a low minimum density).

EXAMPLE 6

Method for Preparation of Dispersion of Dye Providing Substance CI-17 in Gelatin A mixture of 5 g of Dye Providing Substance CI-17 shown below, 4 g of an electron donative substance shown below, 0.5 g of sodium 2-ethylhexyl sulfosuccinate, 10 g of tricresyl phosphate (TCP) and 20 ml of cyclohexanone was dissolved by heating at about 60° C. to prepare a solution. This solution was mixed with 100 g of a 10 wt % aqueous solution of gelatin with stirring and the mixture was dispersed by means of a homogenizer at 10,000 rpm for 10 minutes.

Dye Providing Substance CI-17:

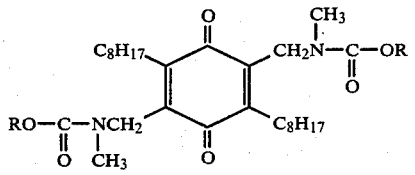

wherein R represents a group having the following formula:

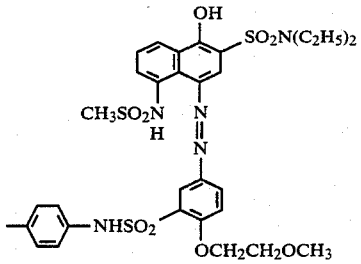

Electron Donative Substance:

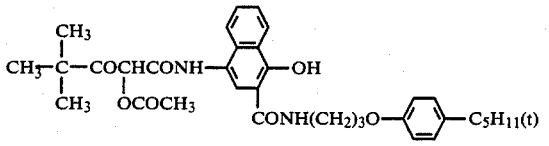

A light-sensitive coating solution was prepared as follows:

| | | |
|---|---|---|
| (6-a) | Silver benzotriazole emulsion containing light-sensitive silver bromide (same as described in Example 5) | 10 g |
| (6-b) | Dispersion of Dye Providing Substance CI-17 (described above) | 3.5 g |
| (6-c) | Base Precursor (24) according to the present invention | 0.44 g |
| (6-d) | 5 vol % Aqueous solution of a compound having the following formula: | 1.5 ml |

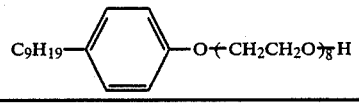

The above components (6-a) to (6-d) and 4 ml of water were mixed and dissolved by heating and the mixture was coated on a polyethylene terephthalate film at a wet layer thickness of 30 μm and dried to prepare a light-sensitive material.

The light-sensitive material thus obtained was exposed imagewise at 2,000 lux for 10 seconds using a tungsten lamp and then uniformly heated for 40 seconds on a heat block at 140° C.

The same image receiving material as described in Example 2 was soaked in water and then superimposed on the above heated light-sensitive material so that their coated layers were in contact with each other.

The positive magenta color image was obtained in the image receiving material. The density of the positive image was measured by means of a Macbeth reflection densitometer (RD-519). The maximum density and minimum density to green light were 2.06 and 0.32, respectively.

These results demonstrate the effectiveness of the base precursor according to the present invention.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising a support having thereon at least one light-sensitive silver halide emulsion layer comprising light-sensitive silver halide and a binder, and at least one layer on said support comprises as a base precursor a compound represented by the following general formula (I):

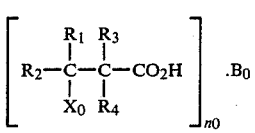

(I)

wherein $R_1$ and $R_2$, which may be the same or different, each represents a hydrogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, a substituted or unsubstituted heterocyclic group, a carboxy group or a salt thereof; $R_3$ and $R_4$, which may be the same or different, each represents a hydrogen atom, a halogen atom a substituted or unsubstituted alkyl group, a substituted or unsubstituted cycloalkl group, a substituted or unsubstituted alkenyl group, a substituted or unsubstituted alkynyl group, a substituted or unsubstituted aryl group, a substituted or unsubstituted heterocyclic group, a substituted or unsubstituted sulfamoyl group, a substituted or unsubstituted carbamoyl group, a substituted or unsubstituted acyl group, a substituted or unsubstituted alkoxy group, a substituted or unsubstituted aryloxy group, a substituted or unsubstituted amino group, a substituted or unsubstituted acylamino group, a substituted or unsubstituted alkoxycarbonyl group, a substituted or unsubstituted aryloxycarbonyl group, a substituted or unsubstituted acyloxy group, a phosphoryl group substituted with a substituted or unsubstituted alkyl group or aryl group, a phosphinyl group substituted with a substituted or unsubstituted alkyl group or aryl group, a thio group substituted with a substituted or unsubstituted alkyl group or aryl group, a sulfinyl group substituted with a substituted or unsubstituted alkyl group or aryl group or a sulfonylamino group substituted with a substituted or unsubstituted alkyl group or aryl group, a cyano group, a hydroxy group, a carboxy group or a salt thereof; $X_0$ represents a group capable of accelerating decarboxylation selected from the group consisting of an alkoxy group, an aryloxy group, an acylamino group, a sulfonylamino group, an imido group, an acyloxy group, an alkylthio group, an arylthio group, an alkoxycarbonyloxy group, an aryloxycarbonyloxy group, a dialkylcarbamoyloxy group and a nitrogen-containing heterocyclic group; $B_0$ represents an organic base; and $n_0$ represents 1 when $B_0$ represents a monoacidic base or 2 when $B_0$ represents a diacidic base, said light-sensitive material containing a reducing agent.

2. A heat developable light-sensitive material as claimed in claim 1, wherein $R_1$ and $R_2$ each represents a hydrogen atom, a substituted or unsubstituted alkyl group having from 1 to 8 carbon atoms, a substituted or unsubstituted aryl group having from 6 to 10 carbon atoms or a substituted or unsubstituted aralkyl group having from 7 to 12 carbon atoms.

3. A heat developable light-sensitive material as claimed in claim 1, wherein the substituent for the substituted group represented by $R_1$ or $R_2$ is an alkoxy group, an alkyl group, a halogen atom, a dialkylamino group, a hydroxy group or an aryloxy group.

4. A heat developable light-sensitive material as claimed in claim 1, wherein $R_3$ and $R_4$ each represents a hydrogen atom, a halogen atom, a substituted or unsubstituted alkyl group having from 1 to 8 carbon atoms, a substituted or unsubstituted aryl group having from 6 to 10 carbon atoms or a substituted or unsubstituted aralkyl group having from 7 to 12 carbon atoms, a cyano group, an alkylsulfonyl group, an arylsulfonyl group, a substituted or unsubstituted sulfamoyl group, a dialkylphosphoryl group, a dialkylphosphinyl group, a diarylphosphinyl group, an alkylthio group or an arylthio group.

5. A heat developable light-sensitive material as claimed in claim 1, wherein the substituent for the substituted group represented by $R_3$ or $R_4$ is a halogen atom, a cyano group, an alkylsulfonyl group, an alkyl group, an alkoxy group, an acyl group, an acyloxy group or an acylamino group.

6. A heat developable light-sensitive material as claimed in claim 1, wherein $X_0$ represents a group derived from a conjugated acid having a pKa of about 20 or less.

7. A heat developable light-sensitive material as claimed in claim 1, wherein the group represented by $X_0$ is substituted with a substituent selected from the group consisting of an alkyl group, an alkoxy group, a hydroxy group, a cyano group, an acyloxy group, an acyl group, an acylamino group, a halogen atom, a sulfonyl group and a nitro group.

8. A heat developable light-sensitive material as claimed in claim 1, wherein $B_0$ represents an organic base having a pKa of at least 7 and 12 or ferwe carbon atoms.

9. A heat developable light-sensitive material as claimed in claim 1, wherein $B_0$ represents an organic base having a pKa of about 10 or more, a boiling point of about 150° C. or higher and low volatility.

10. A heat developable light-sensitive material as claimed in claim 1, wherein the organic base represented by $B_0$ is a guanidine, a cyclic guanidine, an amidine, a cyclic amidine or a tetraalkyl ammonium hydroxide.

11. A heat developable light-sensitive material as claimed in claim 1, wherein the base precursor is present in an amount of about 50% by weight or less based on the amount of a coating composition of the light-sensitive material(dry basis).

12. A heat developable light-sensitive material as claimed in claim 1, wherein the base precursor is present in an amount of from about 0.01% by weight to 40% by weight based on the amount of a coating composition of the light-sensitive material(dry basis).

13. A heat developable light-sensitive material as claimed in claim 1, wherein the light-sensitive layer contains a light-sensitive silver halide emulsion and the compound represented by general formula (I).

14. A heat developable light-sensitive material as claimed in claim 13, wherein the silver halide emulsion is a spectrally sensitized silver halide emulsion.

15. A heat developable light-sensitive material as claimed in claim 13, wherein the light-sensitive layer further contains an organic silver salt oxidizing agent.

16. A heat developable light-sensitive material as claimed in claim 15, wherein the organic silver salt oxidizing agent is (a) a silver salt of an organic compound having a carboxy group, (b) a silver salt of a compound containing a mercapto group or a thione group, or (c) a silver salt of a compound having an imino group.

17. A heat developable light-sensitive material as claimed in claim 13, wherein the light-sensitive layer further contains an image forming substance.

18. A heat developable light-sensitive material as claimed in claim 17, wherein the image forming substance is a coupler capable of forming a color image by bonding to an oxidation product of a developing agent.

19. A heat developable light-sensitive material as claimed in claim 17, wherein the image forming substance is a dye providing substance.

20. A heat developable light-sensitive material as claimed in claim 19, wherein the dye providing substance is a compound represented by the following formula (CI):

$$(\text{Dye}-X)_q-Y \qquad \text{(CI)}$$

wherein Dye represents a dye capable of becoming mobile when it is released from the molecule of the compound represented by the formula (CI); X represents a simple bond or a connecting group; q represents 1; and Y represents a group which releases Dye in correspondence or countercorrespondence to light-sensitive silver salts having a latent image distributed imagewise, the diffusibility of Dye released being different from that of the compound represented by $(Dye—X)_q—Y$.

21. A heat developable light-sensitive material as claimed in claim 20, wherein Dye represents a dye having a hydrophilic group.

22. A heat developable light-sensitive material as claimed in claim 20, wherein the dye represented by Dye is an azo dye, an azomethine dye, an anthraquinone dye, a naphthoquinone dye, a styryl dye, a nitro dye, a quinoline dye, a carbonyl dye or a phthalocyanine dye.

23. A heat developable light-sensitive material as claimed in claim 20, wherein the connecting group represented by X is —NR— wherein R represents a hydrogen atom, an alkyl group, or a substituted alkyl group, $—SO_2—$, —CO—, an alkylene group, a substituted alkylene group, a phenylene group, a substituted phenylene group, a naphthylene group, a substituted naphthylene group, —O—, —SO—, or a group containing two or more of the foregoing groups in combination.

24. A heat developable light-sensitive material as claimed in claim 13, wherein the light-sensitive layer further contains a reducing agent.

25. A heat developable light-sensitive material as claimed in claim 19, wherein the light-sensitive layer further contains a dye releasing activator.

26. A heat developable light-sensitive material as claimed in claim 1, wherein $X_0$ is selected from the group consisting of an alkoxy group, an aryloxy group, a sulfonylamino group, an imido group, an alkoxycarbonyloxy group, an aryloxycarbonyloxy group, a dialkylcarbamoyloxy group, and a nitrogen-containing heterocyclic group.

27. A heat developable light-sensitive material as claimed in claim 1, wherein $X_0$ is selected from the group consisting of a sulfonylamino group, an imido group, and a nitrogen-containing heterocyclic group.

* * * * *